US006666001B2

(12) United States Patent
Mero

(10) Patent No.: US 6,666,001 B2
(45) Date of Patent: Dec. 23, 2003

(54) PLASTIC CONTAINER HAVING AN OUTWARDLY BULGED PORTION

(75) Inventor: Christopher J. Mero, New Milford, CT (US)

(73) Assignee: PepsiCo Inc., Purchase, NY (US)

( * ) Notice: Subject to any disclaimer, the term of this patent is extended or adjusted under 35 U.S.C. 154(b) by 5 days.

(21) Appl. No.: 10/061,496

(22) Filed: Feb. 1, 2002

(65) Prior Publication Data

US 2002/0070193 A1 Jun. 13, 2002

Related U.S. Application Data

(62) Division of application No. 09/368,925, filed on Aug. 5, 1999, now abandoned.

(51) Int. Cl.[7] ..... B65B 61/14; B65B 47/00

(52) U.S. Cl. ..... 53/413; 53/453; 53/134.1; 53/141; 53/561; 215/381

(58) Field of Search ..... 53/140, 141, 473, 53/413, 452, 453, 561, 578, 134.1; 264/524; 425/524; 215/379, 381

(56) References Cited

U.S. PATENT DOCUMENTS

| | | | | | |
|---|---|---|---|---|---|
| D184,164 | S | | 12/1958 | Brownstein | |
| D190,835 | S | | 7/1961 | Fuerst | |
| 3,468,443 | A | | 9/1969 | Marcus | |
| 3,871,541 | A | | 3/1975 | Adomaitis | |
| 3,998,030 | A | * | 12/1976 | Straub | 53/452 |
| 4,040,233 | A | * | 8/1977 | Valyi | 425/524 |
| 4,054,017 | A | * | 10/1977 | Naumann | 53/140 |
| 4,108,324 | A | | 8/1978 | Krishnakumar et al. | |
| 4,254,882 | A | | 3/1981 | Yoshino | |
| 4,294,366 | A | | 10/1981 | Chang | |
| 4,318,489 | A | | 3/1982 | Snyder et al. | |
| 4,318,882 | A | * | 3/1982 | Agrawal et al. | 264/524 |
| 4,334,627 | A | | 6/1982 | Krishnakumar et al. | |
| 4,352,435 | A | | 10/1982 | Yoshino et al. | |
| 4,355,728 | A | | 10/1982 | Yoshino et al. | |
| 4,403,706 | A | | 9/1983 | Mahajan | |
| 4,497,855 | A | | 2/1985 | Agrawal et al. | |
| 4,550,007 | A | | 10/1985 | Ohtsu et al. | |
| 4,589,559 | A | | 5/1986 | Hayashi et al. | |
| 4,591,066 | A | | 5/1986 | Moen | |
| 4,618,515 | A | | 10/1986 | Collette et al. | |
| D292,269 | S | | 10/1987 | Jacobs et al. | |
| 4,749,092 | A | | 6/1988 | Sugiura et al. | |
| 4,803,036 | A | | 2/1989 | Maruhashi et al. | |
| 4,889,247 | A | | 12/1989 | Collette et al. | |
| D305,984 | S | | 2/1990 | Alberghini et al. | |
| 4,905,450 | A | * | 3/1990 | Hansen et al. | 53/453 |
| 4,926,613 | A | * | 5/1990 | Hansen | 53/453 |
| 4,946,053 | A | | 8/1990 | Conrad | |
| 4,969,563 | A | | 11/1990 | Strassheimer | |
| 4,978,015 | A | | 12/1990 | Walker | |
| D315,869 | S | | 4/1991 | Collette | |

(List continued on next page.)

*Primary Examiner*—Stephen F. Gerrity
(74) *Attorney, Agent, or Firm*—Scully, Scott, Murphy & Presser

(57) ABSTRACT

A blow molded plastic beverage container, comprising neck, shoulder, body and base portions. A bulge is formed in one, or both, of the shoulder and base portions bulging to facilitate gripping and handling the container. Preferably, a respective bulge is formed in both the shoulder and base portions, forming a pair of bulges that bracket the container body. Also, preferably, grooves are formed in the shoulder and base portions of the container to facilitate formation of the bulges. The container is formed in a multi-step process from a preform that may have a conventional design. In this process, the preform is expanded into an initial container shape having a neck portion, a shoulder portion, a body portion, and a base portion. That container is filled with a beverage, and a bulge is formed in one, or both, of the shoulder and base portions of the container. For example, the container may be filled with a beverage at greater than ambient pressure, and this greater than ambient pressure may be used to form bulges in the shoulder and base portions of the container.

17 Claims, 2 Drawing Sheets

U.S. PATENT DOCUMENTS 5,024,340 A 6/1991 Alberghini et al.
5,038,947 A 8/1991 Strassheimer
5,054,632 A 10/1991 Alberghini et al.
5,060,453 A * 10/1991 Alberghini et al. ..... 53/471
5,080,244 A 1/1992 Yoshino
5,092,475 A 3/1992 Krishnakumar et al.
5,122,327 A 6/1992 Spina et al.
5,261,543 A 11/1993 Ugarelli
5,303,833 A 4/1994 Hayashi et al.
5,337,909 A 8/1994 Vailliencourt
5,341,946 A 8/1994 Vailliencourt et al.
5,407,086 A 4/1995 Ota et al.
5,484,072 A 1/1996 Beck et al.
5,579,937 A * 12/1996 Valyi ..... 264/524
5,593,056 A 1/1997 Mero et al.
D379,152 S 5/1997 Richardson
D386,088 S 11/1997 Satoh
5,735,421 A 4/1998 Deemer et al.
5,740,934 A 4/1998 Brady
5,785,197 A 7/1998 Slat
5,848,516 A * 12/1998 Ban ..... 53/453
D404,651 S 1/1999 Warner et al.
D406,065 S 2/1999 Cheng
D410,197 S 5/1999 Herrin
5,908,128 A * 6/1999 Krishnakumar et al. .... 215/381
D420,594 S 2/2000 Weinstein et al.
D429,156 S 8/2000 Williams et al.
6,112,925 A 9/2000 Nahill et al.

* cited by examiner

PLASTIC CONTAINER HAVING AN OUTWARDLY BULGED PORTION

This application is a divisional of U.S. application Ser. No. 09/368,925, filed Aug. 5, 1999 (abandoned).

BACKGROUND OF THE INVENTION

The present invention generally relates to plastic containers for beverages, particularly carbonated soft drink products and the like. More specifically, this invention relates to a blow molded plastic container, and to a method of forming that container, having at least one outward bulge immediately adjacent the body portion. This outward bulge portion has the practical effect of lending improved grip and manual handling characteristics to the container.

The use of plastic containers to package beverages, especially carbonated soft drink products, has been remarkably successful since such containers were first introduced in the 1970s. The widespread application of these containers primarily stems from the fact that the plastic material from which they are made can be biaxially oriented. These plastic materials, it may be noted, are invariably thermoplastics, most especially polyesters such as polyethylene terephthalate (PET).

Biaxial orientation involves aligning the polymer chains in two directions, and the consequence of this orientation is a closer, more orderly packing of material. The practical benefits of this phenomenon are two fold: first, containers thus oriented can be produced with thin walls, often as a direct result of the orienting process itself; and second, the mechanical strength and gas barrier properties of these thin wall containers increases dramatically upon biaxial orientation. The overall result is a container that is light weight, yet extremely robust.

A number of ways are known to fabricate these biaxially oriented containers. The most commercially important of these fabrication procedures, however, are those that employ stretch blow molding techniques. These techniques generally utilize a preform or parison, typically produced by way of injection molding, that is heated, or cooled, as the case may be, to at or near the glass transition temperature of the material. When at this temperature, the preform is placed into a blow mold in which the preform is longitudinally stretched by a stretch rod and horizontally expanded by air or other operating gas pressure. The resulting product is a container whose body and shoulder portions have relatively thin walls and are biaxially oriented.

Although the thin wall construction of biaxially-oriented containers is advantageous overall, there are, nevertheless, some drawbacks to this construction. For example, because of its thin nature, the container wall has little tolerance for a topical configuration that is other than smooth, uniform and continuous. Thus, even though it may be desirable to provide alterations or embellishments to the wall, it has been difficult to do so without adversely affecting the mechanical integrity of the wall.

Of the efforts made in this regard are those directed to providing the container walls with designs or features, such as ridges or ribs in the shoulder portions of such containers, in order to improve the consumer's ability to hold and handle the container. While important improvements have been made in this regard, the art still recognizes a continuing need to develop a container design or feature that will improve the consumer's ability to grip and handle the container and that will not detract from the mechanical integrity of the container.

SUMMARY OF THE INVENTION

An object of this invention is to improve plastic, blow molded beverage containers.

Another object of the present invention is to provide a plastic, blow molded beverage container with improved handling characteristics.

A further object of this invention is to bulge outwardly one or both of the shoulder and base portions of a plastic, blow molded beverage container to make it easier to grip and to handle the container.

Another object of the present invention is to employ a greater than ambient pressure, present when a plastic, blow molded beverage container is filled with a beverage, to form two spaced apart bulges in the container that facilitate gripping and handling the container.

These and other objective are attained with a blow molded plastic beverage container, comprising a neck portion adapted to receive a closure, a body portion, a shoulder portion integrally connected to and extending between the neck portion and the body portion, and a base portion integrally connected to and extending from the base portion and closing a bottom end of the container. A bulge is formed in one, or both, of the shoulder and base portions bulging to facilitate gripping and handling the container. Preferably, a respective bulge is formed in each of the shoulder and base portions, forming a pair of bulges that bracket the container body. Also, preferably, grooves are formed in the shoulder and base portions of the container to facilitate formation of the bulges.

The container is formed in a multi-step process from a preform that may have a conventional design. In this process, the preform is expanded into an initial container shape having a neck portion, a shoulder portion, a body portion, and a base portion. That container is filled with a beverage, and a bulge is formed in one, or both, of the shoulder and base portions of the container. Preferably, the bulge or bulges are formed while the container is being filled with the beverage. For example, the container may be filled with a beverage at greater than ambient pressure, and this greater than ambient pressure may be used to bulge the shoulder and base portions outwardly of the container body.

Further benefits and advantage of the invention will become apparent from a consideration of the following detailed description, given with reference to the accompanying drawings, which specify and show preferred embodiments of the invention.

DETAILED DESCRIPTION OF THE PREFERRED EMBODIMENT

Figure 1:
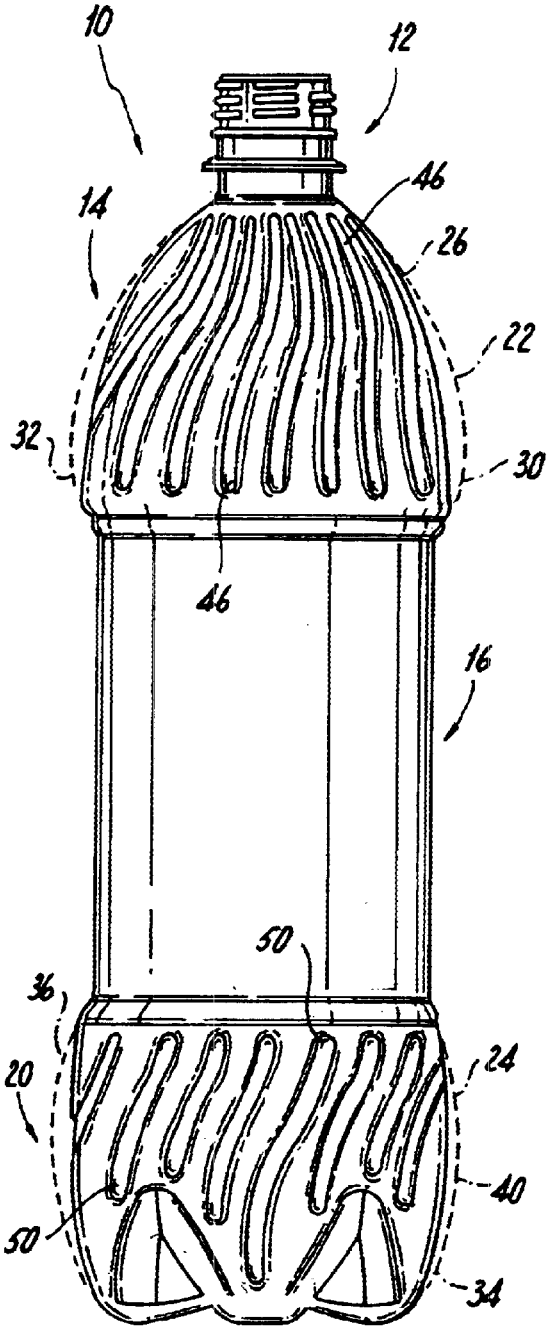
FIG. 1 depicts a container embodying and made in accordance with the present invention.

FIG. 1 depicts container 10 comprising a neck portion 12 adapted to receive a closure, a shoulder portion 14, a body portion 16, which is generally tubular in shape, and a bottom or base portion 20, which may be of either the petaloid or champagne push-up type, petaloid being depicted. As will be appreciated by those of ordinary skill in the art, for purposes of the present invention, the bottom portion 20 may also be outwardly hemispherical, which normally requires the conjoint use of a base cup. The particular container 10 illustrated has a size of about 1500 ml.

As discussed in greater detail below, container 10 is made by the blow molding a preform into an initial shape, shown in full lines in FIG. 1, and then bulging out, preferably, both the shoulder and base portions into a final shape, shown in broken lines in FIG. 1. More specifically, in the bulged shape, shoulder portion 14 and base portion 20 both bulge outwardly of body portion 16—that is, the shoulder portion and the base portion form respective bulges 22 and 24, both of which project outwardly of the cylinder defined by the body portion 16. In the bulged state, shoulder portion 14 has a dome shape and includes an upper portion 26 and a lower, truncated spherical portion 30. Upper portion 26 extends downwardly outwardly from neck portion 12. Truncated spherical portion 30 has a generally uniform radius of curvature and a horizontal midsection 32 defining a maximum diameter of the truncated spherical portion. Truncated spherical portion 30 extends downwardly outwardly, at the above-mentioned generally uniform radius of curvature, from upper portion 26 to midsection 32. Portion 30 then extends downwardly inwardly, also at this radius of curvature from midsection 32 to body portion 16 of container 10.

In to bulged state, base portion 20 includes a lower portion 34 and an upper, truncated spherical portion 36. Truncated spherical portion 36 has a generally uniform radius of curvature and a horizontal midsection 40 defining a maximum diameter of the truncated spherical portion. Truncated spherical portion 36 extends downwardly outwardly, at the above-mentioned generally uniform radius of curvature, from body portion 16 to midsection 40. Portion 36 then extends downwardly inwardly, also at this radius of curvature from midsection 40 to lower base portion 34.

Preferably, a plurality of grooves are formed in both the shoulder and base portions 14 and 20 to facilitate forming bulges 22 and 24. As illustrated in FIG. 1, the grooves 46 formed in the shoulder portion 14 extend along substantially the entire length of the shoulder portion and have termini proximate neck portion 12 and termini proximate body portion 16. Preferably these grooves 46 are in the form of a spiral, the particular embodiment illustrated showing the spiral diverging as it proceeds from that part of the shoulder portion 14 proximate neck portion 12 to that part proximate body portion 16.

Figure 2:
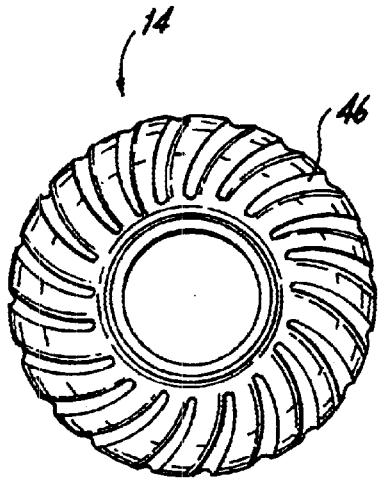
FIG. 2 is a top view of the container.
Figure 4:
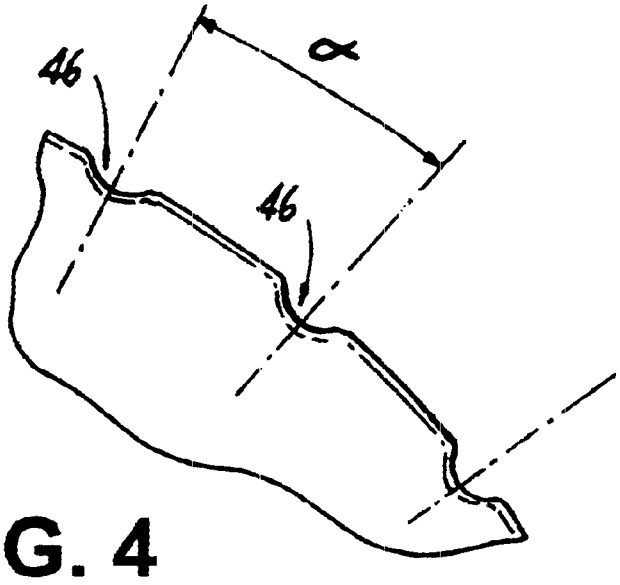
FIG. 4 is a partial enlargement of a cross-section of the container illustrating details of grooves in a shoulder portion of the container.

With reference to FIGS. 1, 2 and 4, grooves 46 are circumferentially disposed about shoulder portion 14, and the grooves are spaced apart and separated from one another by an angle $\alpha$, which is formed by two radii of the shoulder portion that bisect adjacent grooves. Also, as illustrated in FIGS. 1, 2 and 4 preferably the outer surface of the shoulder portion 14 between each of the grooves 46 is substantially smooth.

As particularly shown in FIG. 2, shoulder portion 14 has twenty grooves 46.

Figure 5:
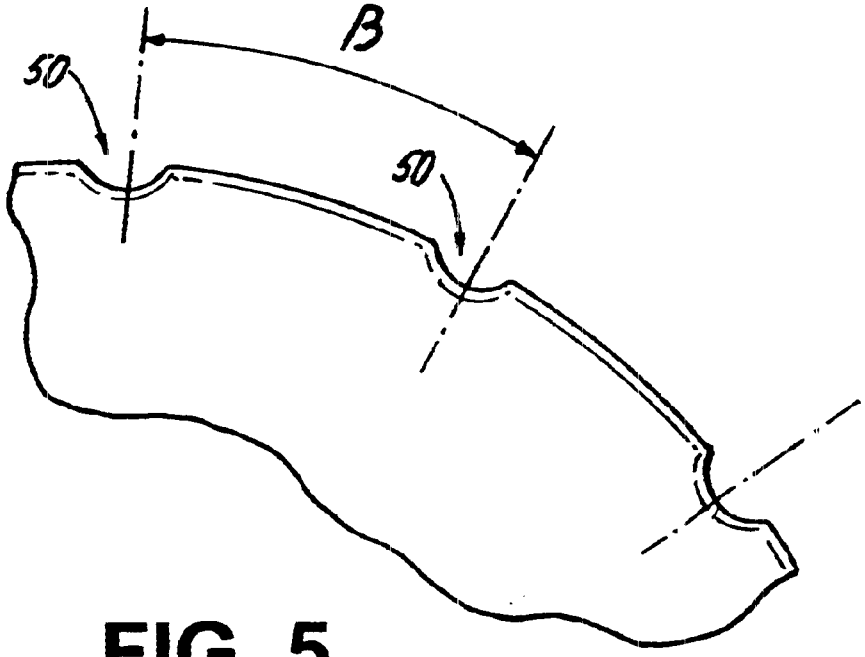
FIG. 5 is a partial enlargement of a cross-section of the container showing details of grooves in a base portion of the container.

The grooves 50 formed in base portion 20 have a curved shape, and are equally spaced around the circumference of the base portion. As illustrated in FIG. 1, the grooves 50 formed in the base portion 20 extend along substantially the entire length of the outer side of the base portion and have upper termini proximate body portion and lower termini. With reference to FIG. 5, grooves 50 are spaced apart and are separated from one another by an angle B, which is formed by two radii of base portion.

Figure 3:
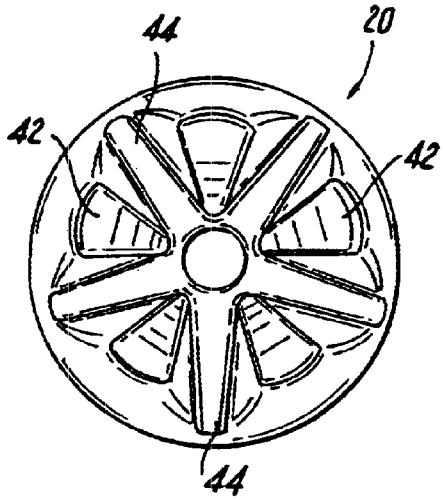
FIG. 3 is a bottom view of the container.

As will be understood by those of ordinary skill in the art, numerous modifications may be made to the specific container design shown in FIGS. 1–3. For example, and without limitation, the number and spacing of the grooves 46 and 50 may vary. Also, the grooves 46 and 50 may extend along only a part of the length of the shoulder and base portions 14 and 20. Moreover, the lengths of the shoulder and base portions themselves can vary depending upon the size and other conformational characteristics of the container. Preferably, for example, the shoulder length is generally equal to about 30% of the total height of the container.

Container 10 is formed in a multi-step process from a preform that may have a conventional design. More specifically, the preform is expanded into an initial container shape, shown in full lines in FIG. 1, having a neck portion, a shoulder portion, and a body portion. That container is filled with a beverage, and the shoulder and base portions of the container are bulged outwardly of the body portion to form the bulges 22 and 24 of container 10. Preferably, these bulges are formed while the container is being filled with the beverage. For example, the container may be filled with a beverage at greater than ambient pressure, and this greater than ambient pressure may be used to bulge the shoulder and base portions 14 and 20 outwardly of the container body 16. In addition, preferably, grooves 46 and 50 are formed in shoulder and base portions 14 and 20 as the preform is expanded into the initial container shape shown in full lines in FIG. 1.

Conventional fabrication techniques, well known in the art, may be employed in the practice of this invention. Of the more preferable methods in this regard is stretch blow molding, using a preform or parison of convention design and a blow mold where the aspect of the mold that corresponds to the shoulder and base portions of the initially formed container is configured so as to produce the shoulder and base portions, preferably including grooves 46 and 50. As will be appreciated by those of ordinary skill in the art, the present invention may be implemented in containers of any size, including, without limitation, sizes commonly found in commercial use such as from 0.33 liter to 2.0 liters and larger.

In practice, the present invention can be successfully implemented in containers having thin wall portions. In general, the wall thickness of shoulder portions contemplated in this regard are from about 0.22 mm to about 0.35 mm, more typically from about 0.25 mm to about 0.28 mm. As will be appreciated by those of ordinary skill in the art, this magnitude of wall thickness is commonly employed in non-returnable beverage containers, also known as one-way or disposable containers. The present invention need not be limited to such containers, however.

While any plastic material suitable for use with beverages, including soft drink products and the like, may be employed in the practice of this invention, it is preferred as a practical matter that thermoplastics, more preferably polyesters, be employed. The most preferred polyester material in this regard is polyethylene terephthalate, or PET. PET as contemplated herein includes homopolymer PET and copolymer PET including, without limitation, those copolymers wherein the ethylene glycol component has been replaced, in part, with e.g., cyclohexane dimethanol, and those wherein the terephthalic acid component is replaced, in part, with, e.g., isophthalic acid. As those of ordinary skill in the art will recognize, the intrinsic viscosity of the PET can vary depending on considerations of use, setting and container conformation, and is generally greater than about 0.55, usually greater than about 0.75. and most commonly about 0.80 to 1.00.

While it is apparent that the invention herein disclosed is well calculated to fulfill the above stated objects, it will be appreciated that numerous modifications and embodiments may be devised by those skilled in the art, and it is intended that the appended claims cover all such modifications and embodiments as fall within the true spirit and scope of the present invention.

What is claimed is:

1. A method of forming a plastic container into a final, bulged shape, comprising the steps of:

providing a preform;

expanding the preform into a container having (i) a neck portion, (ii) a shoulder portion integrally connected to and extending from the neck portion, (iii) a body portion integrally connected to and extending from the shoulder portion, and (iv) a base portion integrally connected to and extending from the body portion;

filling the container with a beverage; and forming a gripping bulge in at least one of the shoulder and base portions to facilitate gripping and handling the container; and wherein the forming step includes the step of forming the bulge while the container is being filled with the beverage.

2. A method according to claim 1, wherein:

the preform has an outside surface; and the expanding step includes the step of forming a series of grooves in said outside surface as the preform is expanded into said container, said grooves facilitating the formation of the bulge.

3. A method according to claim 1, wherein:

the forming step includes the step of bulging the shoulder portion outwardly into a dome shape including an upper portion and a lower, truncated spherical portion;

said upper portion extends downwardly outwardly from said neck portion;

said truncated spherical portion has a generally uniform radius of curvature and a horizontal midsection defining a maximum diameter of the truncated spherical portion; and the truncated spherical portion extends downwardly outwardly, at said radius of curvature, from said upper portion to said midsection, and extends downwardly inwardly, also at said radius of curvature, from said midsection to the body portion of the container.

4. A method according to claim 1, wherein the forming step includes the step of forming bulges simultaneously in both the shoulder and base portions.

5. A method of forming a plastic container into a final, bulged shape, comprising the steps of:

providing a preform;

expanding the preform into a container having (i) a neck portion, (ii) a shoulder portion integrally connected to and extending from the neck portion, (iii) a body portion integrally connected to and extending from the shoulder portion, and (iv) a base portion integrally connected to and extending from the body portion;

filling the container with a beverage; and forming a gripping bulge in at least one of the shoulder and base portions to facilitate gripping and handling the container; and wherein:

the filling step includes the step of filling the container with the beverage at greater than ambient pressure; and the forming step includes the step of using said greater than ambient pressure to form the bulge.

6. A method according to claim 5, wherein:

the preform has an outside surface; and the expanding step includes the step of forming a series of grooves in said outside surface as the preform is expanded into said container, said grooves facilitating the formation of the bulge.

7. A method according to claim 5, wherein:

the forming step includes the step of bulging the base portion outward into a shape including a truncated spherical portion and a lower portion:

said truncated spherical portion has a generally uniform radius of curvature and a horizontal midsection defining a maximum diameter of the truncated spherical portion;

the truncated spherical portion extends downwardly outwardly, at said radius of curvature, from the body portion to said midsection, and extends downwardly inwardly, also at said radius of curvature, from said midsection to the lower portion of the base portion; and said lower portion extends downwardly from said truncated spherical portion.

8. A method according to claim 5, wherein the forming step includes the step of forming bulges simultaneously in both the shoulder and base portions.

9. A method of forming a plastic container into a final, bulged shape, comprising the steps of:

providing a preform;

expanding the preform into a container having (i) a neck portion, (ii) a shoulder portion integrally connected to and extending from the neck portion. (iii) a body portion; integrally connected to and extending from the shoulder portion, and (iv) a base portion integrally connected to and extending from the body portion;

filling the container with a beverage; and forming a gripping bulge in at least one of the shoulder and base portions to facilitate gripping and handling the container: and wherein;

the preform has an outside surface; and the expanding step includes the step of forming a series of grooves in said outside surface as the preform is expanded into said container, said grooves facilitating the formation of the bulge.

10. A method of forming a plastic container into a final, bulged shape, comprising the steps of:

providing a preform;

expanding the preform into a container having (i) a neck portion, (ii) a shoulder portion integrally connected to and extending from the neck portion, (iii) a body portion integrally connected to and extending from the shoulder portion, and (iv) a base portion integrally connected to and extending from the body portion;

filling the container with a beverage; and forming a gripping bulge in at least one of the shoulder and base portions to facilitate gripping and handling the container: and wherein;

the forming step includes the step of bulging the shoulder portion outwardly into a dome shape including an upper portion and a lower, truncated spherical portion;

said upper portion extends downwardly outwardly from said neck portion;

said truncated spherical portion has a generally uniform radius of curvature and a horizontal midsection defining a maximum diameter of the truncated spherical portion; and the truncated spherical portion extends downwardly outwardly, at said radius of curvature, from said upper portion to said midsection, and extends downwardly inwardly, also at said radius of curvature, from said midsection to the body portion of the container.

11. A method of forming a plastic container into a final, bulged shape, comprising the steps of:

providing a preform;

expanding the preform into a container having (i) a neck portion, (ii) a shoulder portion integrally connected to and extending from the neck portion, (iii) a body portion integrally connected to and extending from the shoulder portion, and (iv) a base portion integrally connected to and extending from the body portion;

filling the container with a beverage; and forming a gripping bulge in at least one of the shoulder and base portions to facilitate gripping and handling the container; and wherein:

the forming step includes the step of bulging the base portion outward into a shape including a truncated spherical portion and a lower portion:

said truncated spherical portion has a generally uniform radius of curvature and a horizontal midsection defining a maximum diameter of the truncated spherical portion;

the truncated spherical portion extends downwardly outwardly, at said radius of curvature, from the body portion to said midsection, and extends downwardly inwardly, also at said radius of curvature, from said midsection to the lower portion of the base portion; and said lower portion extends downwardly from said truncated spherical portion.

12. A method of forming a plastic container into a final, bulged shape, comprising the steps of:

providing a preform;

expanding the preform into a container having (i) a neck portion, (ii) a shoulder portion integrally connected to and extending from the neck portion, (iii) a body portion integrally connected to and extending from the shoulder portion, and (iv) a base portion integrally connected to and extending from the body portion;

filling the container with a beverage; and forming a gripping bulge in at least one of the shoulder and base portions to facilitate gripping and handling the container; and wherein the forming step includes the step of forming bulges simultaneously in both the shoulder and base portions.

13. A method according to claim 12, wherein the forming step includes the step of forming bulges simultaneously in both the shoulder and base portions as the container is being filled with the beverage.

14. A method according to claim 13, wherein:

the filling step includes the step of filling the container with the beverage at greater than ambient pressure; and the forming step includes the step of using said greater than ambient pressure to bulge simultaneously both the shoulder and the base portions outwardly of said body portion.

15. A method according to claim 12, wherein:

the preform has an outside surface; and the expanding step includes the step of forming a series of grooves in said outside surface as the preform is expanded into said container, said grooves facilitating the formation of the bulge.

16. A method according to claim 12, wherein:

the forming step includes the step of bulging the shoulder portion outwardly into a dome shape including an upper portion and a lower, truncated spherical portion;

said upper portion extends downwardly outwardly from said neck portion;

said truncated spherical portion has a generally uniform radius of curvature and a horizontal midsection defining a maximum diameter of the truncated spherical portion; and the truncated spherical portion extends downwardly outwardly, at said radius of curvature, from said upper portion to said midsection, and extends downwardly inwardly, also at said radius of curvature, from said midsection to the body portion of the container.

17. A method according to claim 12, wherein:

the forming step includes the step of bulging the base portion outward into a shape including a truncated spherical portion and a lower portion:

said truncated spherical portion has a generally uniform radius of curvature and a horizontal midsection defining a maximum diameter of the truncated spherical portion;

the truncated spherical portion extends downwardly outwardly, at said radius of curvature, from the body portion to said midsection, and extends downwardly inwardly, also at said radius of curvature, from said midsection to the lower portion of the base portion; and said lower portion extends downwardly from said truncated spherical portion.

* * * * *